US009053677B2

(12) United States Patent
Park et al.

(10) Patent No.: US 9,053,677 B2
(45) Date of Patent: Jun. 9, 2015

(54) GATE DRIVING CIRCUIT AND DISPLAY PANEL HAVING THE SAME

(75) Inventors: Soo-Young Park, Seoul (KR); In-Soo Wang, Seongnam-si (KR); Gi-Chang Lee, Seoul (KR); Tae-Hyun Kim, Asan-si (KR); Jeong-Yun Han, Goyang-si (KR)

(73) Assignee: Samsung Display Co., Ltd., Yongin (KR)

( * ) Notice: Subject to any disclaimer, the term of this patent is extended or adjusted under 35 U.S.C. 154(b) by 358 days.

(21) Appl. No.: 13/313,737

(22) Filed: Dec. 7, 2011

(65) Prior Publication Data

US 2013/0009919 A1 Jan. 10, 2013

(30) Foreign Application Priority Data

Jul. 5, 2011 (KR) ..... 10-2011-0066245

(51) Int. Cl.

| | |
|---|---|
| ***G09G 3/36*** | (2006.01) |
| ***G09G 5/00*** | (2006.01) |
| *G09G 3/32* | (2006.01) |

(52) U.S. Cl.

CPC ..... *G09G 3/3677* (2013.01); *G09G 3/3266* (2013.01); *G09G 2300/0408* (2013.01); *G09G 2310/0267* (2013.01)

(58) Field of Classification Search

CPC ..... G09G 2310/0286; G09G 3/3677
USPC ..... 345/87–100, 204; 327/108; 377/80
See application file for complete search history.

(56) References Cited

U.S. PATENT DOCUMENTS

| | | | | |
|---|---|---|---|---|
| 2007/0001991 | A1* | 1/2007 | Jang et al. | 345/100 |
| 2007/0171115 | A1 | 7/2007 | Kim et al. | |
| 2008/0224985 | A1 | 9/2008 | Jang | |
| 2009/0040203 | A1* | 2/2009 | Kim et al. | 345/204 |
| 2010/0134399 | A1 | 6/2010 | Ki et al. | |
| 2010/0207928 | A1 | 8/2010 | Lee et al. | |
| 2010/0238143 | A1* | 9/2010 | Liu et al. | 345/204 |
| 2010/0277206 | A1* | 11/2010 | Lee et al. | 327/108 |
| 2011/0228894 | A1* | 9/2011 | Wang et al. | 377/80 |
| 2012/0146969 | A1* | 6/2012 | Sakamoto et al. | 345/204 |
| 2012/0200544 | A1* | 8/2012 | Iwamoto et al. | 345/204 |

FOREIGN PATENT DOCUMENTS

| | | |
|---|---|---|
| JP | 2007-188079 | 7/2007 |
| JP | 2009-054273 | 3/2009 |
| JP | 2010-152347 | 7/2010 |
| KR | 1020060104352 | 10/2006 |

(Continued)

*Primary Examiner* — Jonathan Boyd
*Assistant Examiner* — James Nokham
(74) *Attorney, Agent, or Firm* — H.C. Park & Associates, PLC

(57) ABSTRACT

Provided is a display panel including: a display area; and a gate driver to receive a first clock signal, a first clock bar signal, a second clock signal and a second clock bar signal, the gate driver comprising a first stage and a second stage to respectively apply a first gate voltage and a second gate voltage to the display area, wherein the first clock signal and the first clock bar signal have opposite phases to each other, the second clock signal and the second clock bar signal have opposite phases to each other, the second clock bar signal has phases later than the first clock bar signal, the first stage discharges the first gate voltage based on the first clock signal and a first transfer signal, and the second stage outputs the first transfer signal based on the second clock bar signal.

36 Claims, 9 Drawing Sheets

(56) References Cited

FOREIGN PATENT DOCUMENTS

| | | |
|---|---|---|
| KR | 1020070043079 | 4/2007 |
| KR | 1020070074826 | 7/2007 |
| KR | 1020080083379 | 9/2008 |
| KR | 1020080114378 | 12/2008 |
| KR | 1020090014540 | 2/2009 |
| KR | 1020100061234 | 6/2010 |
| KR | 1020100083370 | 7/2010 |
| KR | 1020100094613 | 8/2010 |

* cited by examiner

GATE DRIVING CIRCUIT AND DISPLAY PANEL HAVING THE SAME

CROSS-REFERENCE TO RELATED APPLICATION

This application claims priority from and the benefit of Korean Patent Application No. 10-2011-0066245 filed in the Korean Intellectual Property Office on Jul. 5, 2011, which is incorporated herein by reference for all purposes as if fully set forth herein.

BACKGROUND OF THE INVENTION

1. Field of the Invention

A display panel is provided.

2. Discussion of the Background

A display device includes multiple pairs of field generating electrodes and an electro-optical active layer interposed therebetween. Such display device may be a liquid crystal display (LCD), an organic light emitting diode (OLED) display, an electrophoretic display, and the like. The liquid crystal display may include a liquid crystal layer as the electro-optical active is layer and the organic light emitting diode display may include an organic emission layer as the electro-optical active layer. Generally, one of a pair of field generating electrodes is connected to a switching element to receive an electric signal and the electro-optical active layer converts the electric signal into an optical signal to display images.

The display device typically includes a gate driver and a data driver. The gate driver applies to a gate line a gate signal that turns a pixel on or off and the data driver converts image data into a data voltage and then applies the converted data voltage to a data line.

The above information disclosed in this Background section is only for enhancement of understanding of the background of the invention and therefore it may contain information that does not form the prior art that is already known in this country to a person of ordinary skill in the art.

SUMMARY OF THE INVENTION

Additional features of the invention will be set forth in the description which follows, and in part will be apparent from the description, or may be learned by practice of the invention.

An exemplary embodiment of the present invention provides a display panel including: a display area; and a gate driver to receive a first clock signal, a first clock bar signal, a second clock signal and a second clock bar signal, the gate driver comprising a first stage and a second stage to respectively apply a first gate voltage and a second gate voltage to the display area, wherein the first clock signal and the first clock bar signal have opposite phases to each other, the second clock signal and the second clock bar signal have opposite phases to each other, the second clock bar signal has phases later than the first clock bar signal, the first stage is discharges the first gate voltage based on the first clock signal and a first transfer signal, and the second stage outputs the first transfer signal based on the second clock bar signal.

Another exemplary embodiment of the present invention provides a display panel including: a display area; and a gate driver configured to receive a first clock signal, a first clock bar signal, a second clock signal and a second clock bar signal, the gate driver comprising a plurality of stages configured to respectively apply a gate voltage to the display area, wherein the first clock signal and the first clock bar signal have opposite phases to each other, the second clock signal and the second clock bar signal have opposite phases to each other, the second clock bar signal has phases later than the first clock bar signal, and the plurality of stages comprise a first stage configured to receive the first clock signal and output a first transfer signal, and a second stage configured to receive the second clock signal and outputting a second transfer signal.

Yet another exemplary embodiment of the present invention provides a display panel including: a display area; and a gate driver comprising a driving transistor configured to output a gate voltage to the display area, wherein a first clock signal and a first clock bar signal have opposite phases to each other, a second clock signal and a second clock bar signal have opposite phases to each other, the second clock bar signal has phases later than the first clock signal, the driving transistor receives the first clock signal, and a control terminal of the driving transistor is discharged by the second clock bar signal.

Yet another exemplary embodiment of the present invention provides a method for driving a display panel including: receiving a first clock signal, a first clock bar signal, a second clock signal and a second clock bar signal; applying, by a first stage, a first gate voltage to a first gate line; applying, by a second stage, a second gate voltage to a second gate line; is outputting a first transfer signal from the second stage based on the second clock bar signal; and discharging the first gate voltage on the first gate line based on the first clock signal and the first transfer signal, wherein the first clock signal and the first clock bar signal have opposite phases to each other, the second clock signal and the second clock bar signal have opposite phases to each other, and the second clock bar signal has phases later than the first clock bar signal.

It is to be understood that both the forgoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
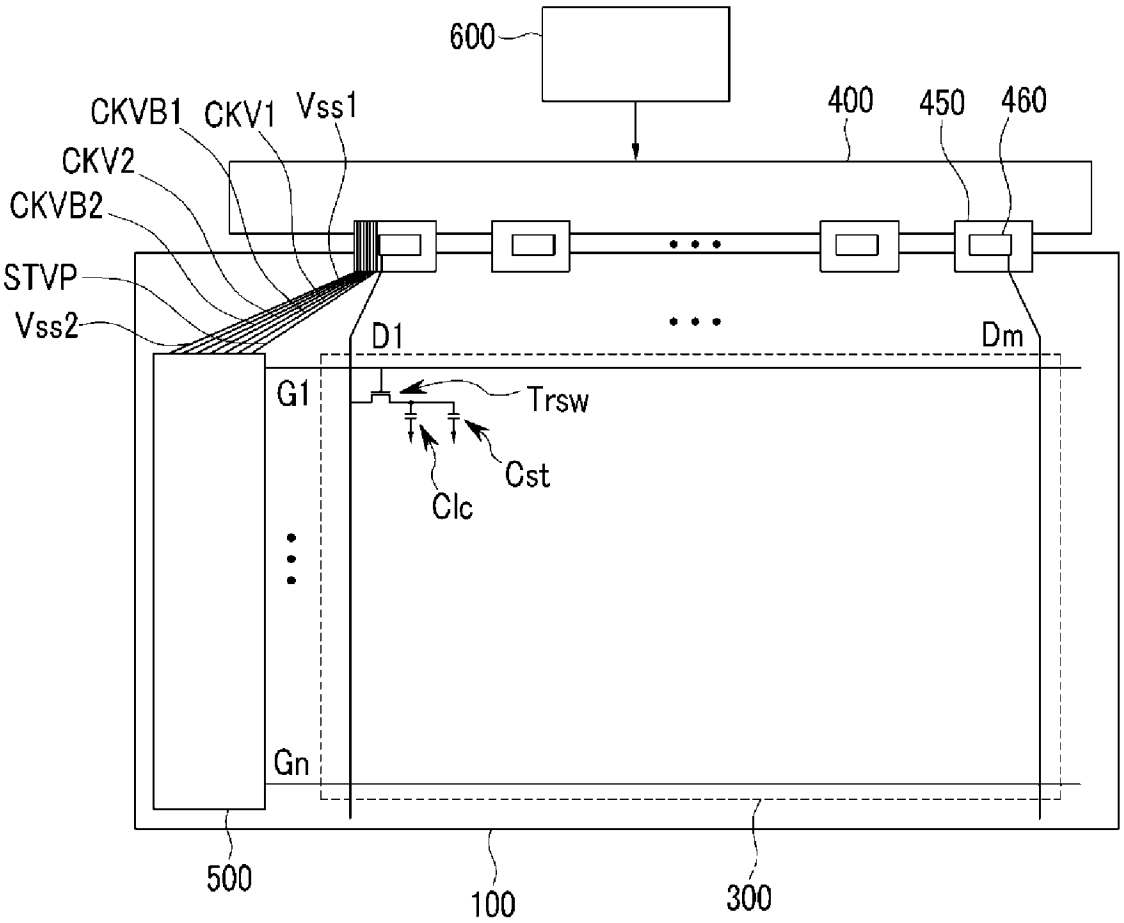
FIG. 1 is a plan view of a display panel according to an exemplary embodiment of the present invention.

The present invention will be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art.

In the drawings, the thickness of layers, films, panels, regions, etc., may be exaggerated for clarity. It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present. In contrast, It will be understood that when an element such as a layer, film, region, or substrate is referred to as being "beneath" another element, it can be directly beneath the other element or intervening elements may also be present. Meanwhile, when an element is referred to as being "directly beneath" another element, there are no intervening elements present.

FIG. 1 is a plan view of a display panel according to an exemplary embodiment of the present invention.

Referring to FIG. 1, a display panel 100 according to an exemplary embodiment of the present invention may include a display area 300 to display images, a gate driver 500 to apply gate voltages to gate lines G1 to Gn, and data driver ICs 460 each to apply a data voltage to one of the data lines D1 to Dm. Each data driver IC 460 may be disposed on a flexible printed circuit film (FPC) 450 attached to the display panel 100. The gate driver 500 and the data driver IC 460 may be controlled by a signal controller 600. A printed circuit board (PCB) may be formed outside the flexible printed circuit film 450 to transfer signals from the signal controller 600 to the data driver IC 460 and the gate driver 500. Signals provided from the signal controller 600 may include signals such as clock signals CKV1, CKVB1, CKV2, and CKVB2, a scan start signal STVP, and signals to provide low voltages Vss1 and Vss2 each having predetermined levels.

Hereinafter, an exemplary embodiment will be described with respect to a liquid crystal panel as the display panel, but the display panel is not limited to the liquid crystal panel and may be an organic light emitting panel, a plasma display panel, an electrophoretic display panel, and the like. The display area 300 in the liquid crystal panel may include a thin film transistor Trsw, a liquid crystal capacitor Clc, and a storage capacitor Cst. The display area 300 in the organic light emitting panel may include a thin film transistor and an organic light emitting diode. The display area 300 in other display panels may include elements such as a thin film transistor and the like.

The display area 300 may include a pixel, gate lines G1 to Gn, and data lines D1 to Dm. The gate lines G1 to Gn and the data lines D1 to Dm are insulated from each other while crossing each other.

The pixel may include a thin film transistor Trsw, a liquid crystal capacitor Clc, and a storage capacitor Cst. The storage capacitor Cst may be omitted. A control terminal of the thin film transistor Trsw may be connected to a gate line, an input terminal of the thin film transistor Trsw may be connected to a data line, and an output terminal of the thin film transistor Trsw may be connected to a terminal of the liquid crystal capacitor Clc and a terminal of the storage capacitor Cst. Another terminal of the liquid crystal capacitor Clc may be connected to a common electrode, and another terminal of the storage capacitor Cst may receive a storage voltage Vcst applied from the signal controller 600.

Each of the data lines D1 to Dm may receive a data voltage from one of the data driver ICs 460, and each of the gate lines G1 to Gn may receive a gate voltage from the gate driver 500.

Each of the data driver IC 460 may be disposed above or below the display panel 100. The data driver ICs 460 may be connected to the data lines D1 to Dm respectively, which extend in a column direction.

The gate driver 500 may receive the clock signals CKV1, CKVB1, CKV2, and CKVB2, the scan start signal STVP, the first low voltage Vss1, and the second low voltage Vss2 to generate gate voltages and applies gate-on voltages to the gate lines G1 to Gn in sequence. The first low voltage Vss1 may be a gate-off voltage and the second low voltage may be a voltage lower than the gate-off voltage. The gate voltage may be the gate-on voltage or the gate-off voltage.

Signal lines applying the clock signals CKV1, CKVB1, CKV2, and CKVB2, the scan start signal STVP, the first low voltage Vss1, and the second low voltage Vss2 to the gate driver 500 may be disposed outside the display area 300. The clock signals CKV1, CKVB1, CKV2, and CKVB2, the scan start signal STVP, the first low voltage Vss1, and the second low voltage Vss2 may be transferred to the flexible printed circuit film 450 from outside or the signal controller 600 through the printed circuit board 400.

Figure 2:
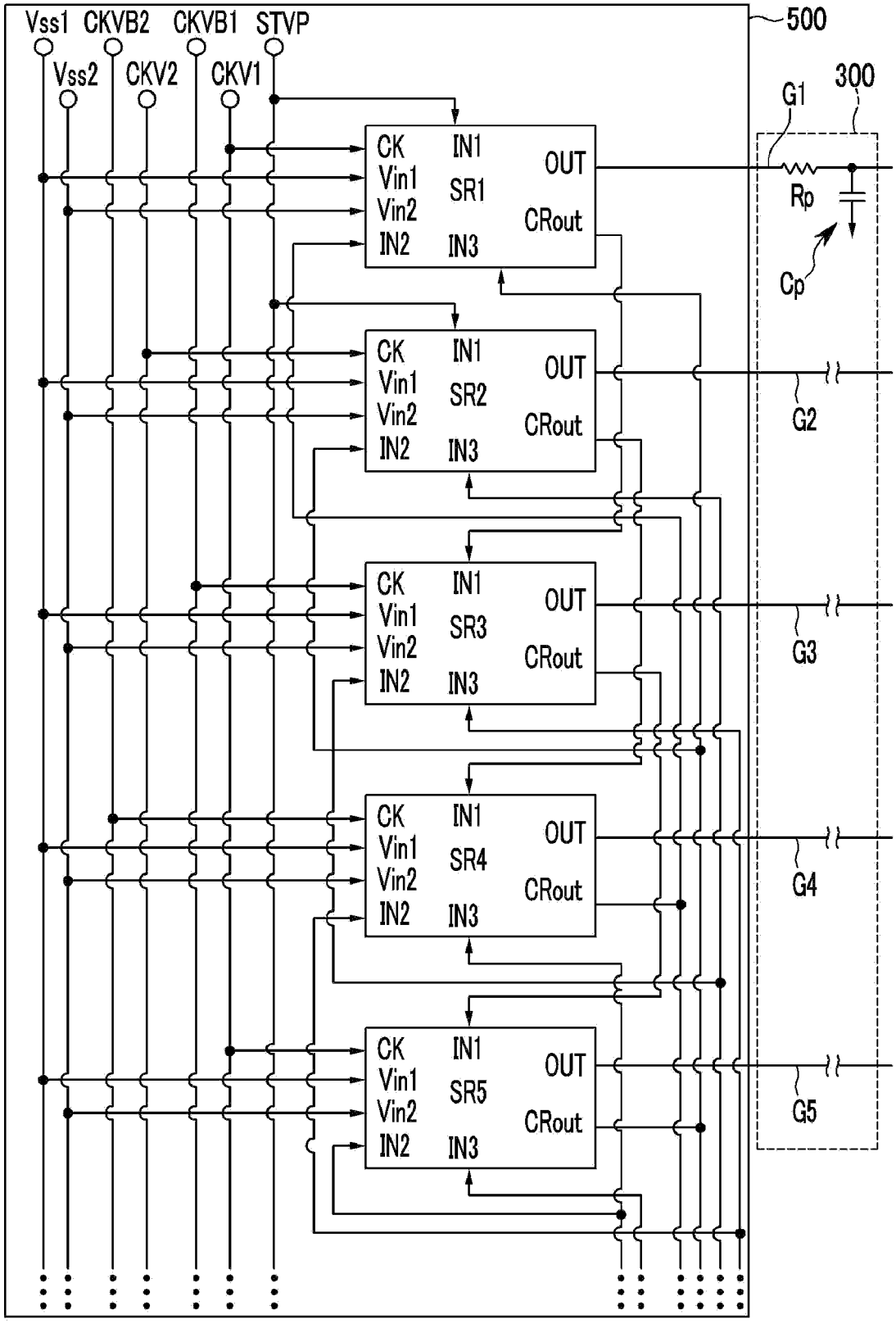
FIG. 2 is a block diagram to show a gate driver and its gate lines according to an exemplary embodiment of the present invention in detail.

FIG. 2 is a block diagram to show the gate driver and its gate lines according to an exemplary embodiment of the present invention in detail.

As shown in FIG. 2, the display area 300 may be represented as a resistor Rp and a capacitor Cp for a gate line. The gate lines G1 to Gn, the liquid crystal capacitor Clc, and the storage capacitor Cst may be represented by the resistor Rp and the capacitor Cp. The gate voltage outputted from a stage SR may be transferred through one of the gate lines G1 to Gn.

The gate driver 500 may include a plurality of stages SR1, SR2, SR3, SR4, and SR5 which are connected in cascade. Each of the stages SR1, SR2, SR3, SR4, and SR5 may include first to third input terminals IN1, IN2, and IN3, a clock input terminal CK, two voltage input terminals Vin1 and Vin2, a gate voltage output terminal OUT to output the gate voltage, and a transfer signal output terminal CRout. Each of the stages SR1, SR2, SR3, SR4, and SR5 may include a transistor and the transistor may include amorphous silicon, an oxide semiconductor, and the like. The oxide semiconductor may comprise an oxide material including at least one of zinc (Zn), indium (In), gallium (Ga), tin (Sn), and hafnium (Hf). For example, the oxide semiconductor may include GIZO (here, G is gallium, I is indium, Z is zinc, and O is oxygen), XIZO (here, X is hafnium, I is indium, Z is zinc, and O is oxygen), and the like.

The gate driver 500 may further include a dummy stage. The gate voltages outputted from normal stages SR1, SR2, SR3, SR4, and SR5 may be transferred to the gate lines, and data voltages may be applied to the pixel to display images. The dummy stage (not shown) may not be connected to a gate line. Although the dummy stage may be connected to a gate line, the dummy stage may be connected to a gate line of a dummy pixel (not shown) which does not display the images, such that the images will not be displayed.

Each of the first to the third input terminals IN1, IN2, and IN3 of a stage may receive a transfer signal outputted from another stage.

A transfer signal of the (n−2)-th stage may be inputted to the first input terminal IN1 of the n-th stage (herein, n is an integer). For example, the transfer signal outputted from the output terminal CRout of the first stage SR1 may be inputted to the first input terminal IN1 of the third stage SR3, the transfer signal outputted from the output terminal CRout of the second stage SR2 may be inputted to the first input terminal IN1 of the fourth stage SR4, and the transfer signal of outputted from the output terminal CRout of the third stage SR3 may be inputted to the first input terminal IN1 of the fifth stage SR5. However, the scan start signal STVP may be inputted to the first input terminal IN1 of the first stage SR1 and the first input terminal IN1 of the second stage SR2.

The transfer signal of the (n+3)-th stage may be inputted the second input terminal IN2 of the n-th stage (here, n is an integer). For example, the transfer signal outputted from the output terminal CRout of the fourth stage SR4 may be inputted to the second input terminal IN2 of the first stage SR1, the transfer signal outputted from the output terminal CRout of the fifth stage SR5 may be inputted to the second input terminal IN2 of the second stage SR2, the transfer signal of the sixth stage SR6 may be inputted to the second input terminal IN2 of the is third stage SR3, the transfer signal of the seventh stage SR7 may be inputted to the second input terminal IN2 of the fourth stage SR4, and the transfer signal of the eighth stage SR8 may be inputted to the second input terminal IN2 of the fifth stage SR5.

The transfer signal of the (n+4)-th stage may be inputted to the third input terminal IN3 of the n-th stage (here, n is an integer). For example, the transfer signal of the fifth stage SR5 may be inputted to the third input terminal IN3 of the first stage SR1, the transfer signal of the sixth stage SR6 may be inputted to the third input terminal IN3 of the second stage SR2, the transfer signal of the seventh stage SR7 may be inputted to the third input terminal IN3 of the third stage SR3, the transfer signal of the eighth stage SR8 may be inputted to the third input terminal IN3 of the fourth stage SR4, and the transfer signal of the ninth stage SR9 may be inputted to the third input terminal IN3 of the fifth stage SR5.

The clock signals CKV1, CKVB1, CKV2, and CKVB2 may be applied to the clock input terminals CKs of a plurality of stages. The first clock signal CKV1 may be inputted to the clock terminal of the (4n−3)-th stage, the first clock bar signal CKVB1 may be inputted to the clock terminal of the (4n−1)-th stage, the second clock signal CKV2 may be inputted to the clock terminal of the (4n−2)-th stage, and the second clock bar signal CKVB2 may be inputted to the clock terminal of the 4n-th stage (here, n is an integer). The first clock signal CKV1 and the first clock bar signal CKVB1 have phases opposite to each other and the second clock signal CKV2 and the second clock bar signal CKVB2 have phases opposite to each other.

The first low voltage Vss1 may be applied to the first voltage input terminal Vin1 of the plurality of stages, and the second low voltage Vss2 may be applied to the second voltage input terminal Vin2 of the plurality of stages. For example, the first low voltage Vss1 may be −5 V and the second low voltage Vss2 may be −10 V, but the low voltages are not particularly is limited thereto.

A stage may receive one of the clock signals CKV1, CKVB1, CKV2, and CKVB2, the first low voltage Vss1, and the second low voltage Vss2 to output a gate voltage to its corresponding gate line and transfer the transfer signal to another stage. The first stage SR1 and the second stage SR2 may also receive the scan start signal STVP.

For example, after receiving the first clock signal CKV1 provided from outside through the clock input terminal CK, the scan start signal STVP through the first input terminal IN1, the first and the second low voltages Vss1 and Vss2 through the first and the second voltage input terminals Vin1 and Vin2, and the transfer signals provided from each of the fourth stage SR4 and the fifth stage SR5 through the second and the third input terminals IN2 and IN3, the first stage SR1 may output the gate voltage to the first gate line G1 through the gate voltage output terminal OUT. The first stage SR1 may output the transfer signal from the transfer signal output terminal CRout and then, may transfer the outputted transfer signal to the first input terminal IN1 of the third stage SR3.

After receiving the second clock signal CKV2 provided from outside through the clock input terminal CK, the scan start signal STVP through the first input terminal IN1, the first and the second low voltages Vss1 and Vss2 through the first and the second voltage input terminals Vin1 and Vin2, and the transfer signals provided from each of the fifth stage SR5 and the sixth stage SR6 through the second and the third input terminals IN2 and IN3, the second stage SR2 may output the gate voltage to the second gate line G2 through the gate voltage output terminal OUT. The second stage SR2 may output the transfer signal from the transfer signal output terminal CRout to transfer the outputted transfer signal to the first input terminal IN1 of the fourth stage SR4.

After receiving the first clock bar signal CKVB1 provided from outside through the clock input terminal CK, the transfer signal provided from the first stage SR1 through the first input terminal IN1, the first and the second low voltages Vss1 and Vss2 through the first and the second voltage input terminals Vin1 and Vin2, and the transfer signals provided from each of the sixth stage SR6 and the seventh stage SR7 through the second and the third input terminals IN2 and IN3, the third stage SR3 may output the gate voltage to the third gate line G3 through the gate voltage output terminal OUT. The third stage SR3 may output the transfer signal from the transfer signal output terminal CRout to transfer the outputted transfer signal to the first input terminal IN1 of the fifth stage SR5.

After receiving the second clock bar signal CKVB2 provided from outside through the clock input terminal CK, the transfer signal provided from the second stage SR2 through the first input terminal IN1, the first and the second low voltages Vss1 and Vss2 through the first and the second voltage input terminals Vin1 and Vin2, and the transfer signals provided from each of the seventh stage SR7 and the eighth stage SR8 through the second and the third input terminals IN2 and IN3, the fourth stage SR4 may output the gate voltage to the fourth gate line G4 through the gate voltage output terminal OUT. The fourth stage SR4 may output the transfer signal from the transfer signal output terminal CRout to transfer the outputted transfer signal to the first input terminal IN1 of the sixth stage SR6 and the second input terminal IN2 of the first stage SR1.

After receiving the first clock signal CKV1 provided from outside through the clock input terminal CK, the transfer signal provided from the third stage SR3 through the first input terminal IN1, the first and the second low voltages Vss1 and Vss2 through the first and the second voltage input terminals Vin1 and Vin2, and the transfer signals provided from each of the is eighth stage SR8 and the ninth stage SR9 through the second and the third input terminals IN2 and IN3, the fifth stage SR5 may output the gate voltage to the fifth gate line G5 through the gate voltage output terminal OUT. The fifth stage SR5 may output the transfer signal from the transfer signal output terminal CRout to transfer the outputted transfer signal to the first input terminal IN1 of the seventh stage SR7, the second input terminal IN2 of the second stage SR1, and the third input terminal IN3 of the first stage SR1.

Figure 3:
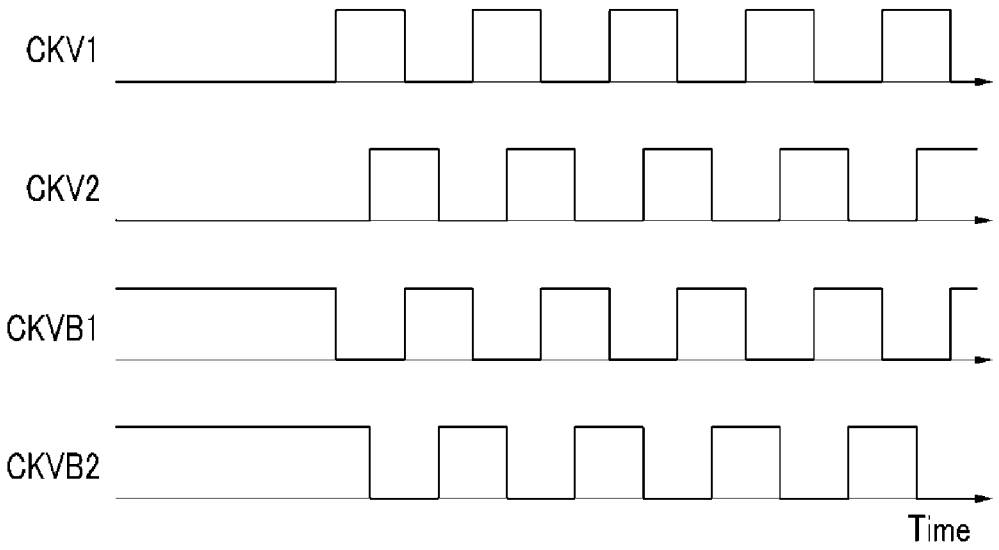
FIG. 3 is a waveform diagram of a clock signal according to an exemplary embodiment of the present invention.

FIG. 3 is a waveform diagram of a clock signal according to an exemplary embodiment of the present invention.

Referring to FIG. 3, an on-pulse of the second clock signal CKV2 may be applied later than an on-pulse of the first clock signal CKV1 and an on-pulse of the second clock bar signal CKVB2 may be applied later than an on-pulse of the first clock bar signal CKVB1. In other words, a rising time of the second clock signal CKV2 may be later than a rising time of the first clock signal CKV1 and a rising time of the second clock bar signal CKVB2 may be later than a rising time of the first clock bar signal CKVB1. Since the stage receiving the first clock signal CKV1 receives the transfer signal from the stage driven by the second clock bar signal CKVB2, as compared with receiving the transfer signal from the stage driven by the first clock bar signal CKVB1, a falling characteristic of the gate-on voltage applied to the gate line may be improved and an accurate data voltage may be applied to the pixel. The first clock signal CKV1 and the first clock bar signal CKVB1 have phases opposite to each other and the second clock signal CKV2 and the second clock bar signal CKVB2 have phases opposite to each other.

For example, when a period of the first clock signal CKV1 and the first clock bar signal CKVB1 is referred to as T, the on-pulse of the second clock signal CKV2 may be applied later than the on-pulse of the first clock signal CKV1 by T/4 and the on-pulse of the second clock is bar signal CKVB2 may be applied later than the on-pulse of the first clock bar signal CKVB1 by T/4.

Figure 4:
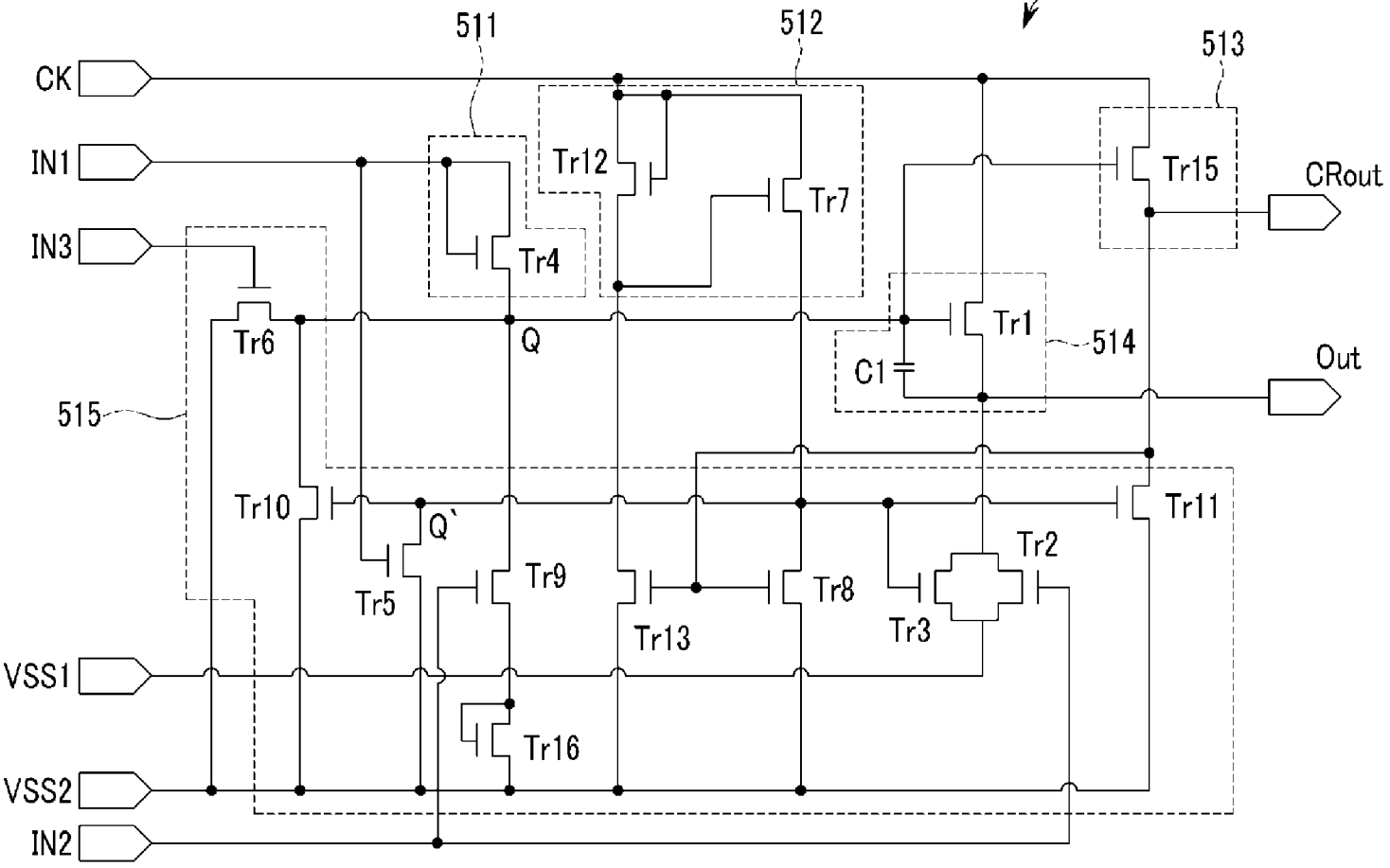
FIG. 4 is an enlarged circuit diagram to show a stage according to an exemplary embodiment of the present invention.
Figure 5:
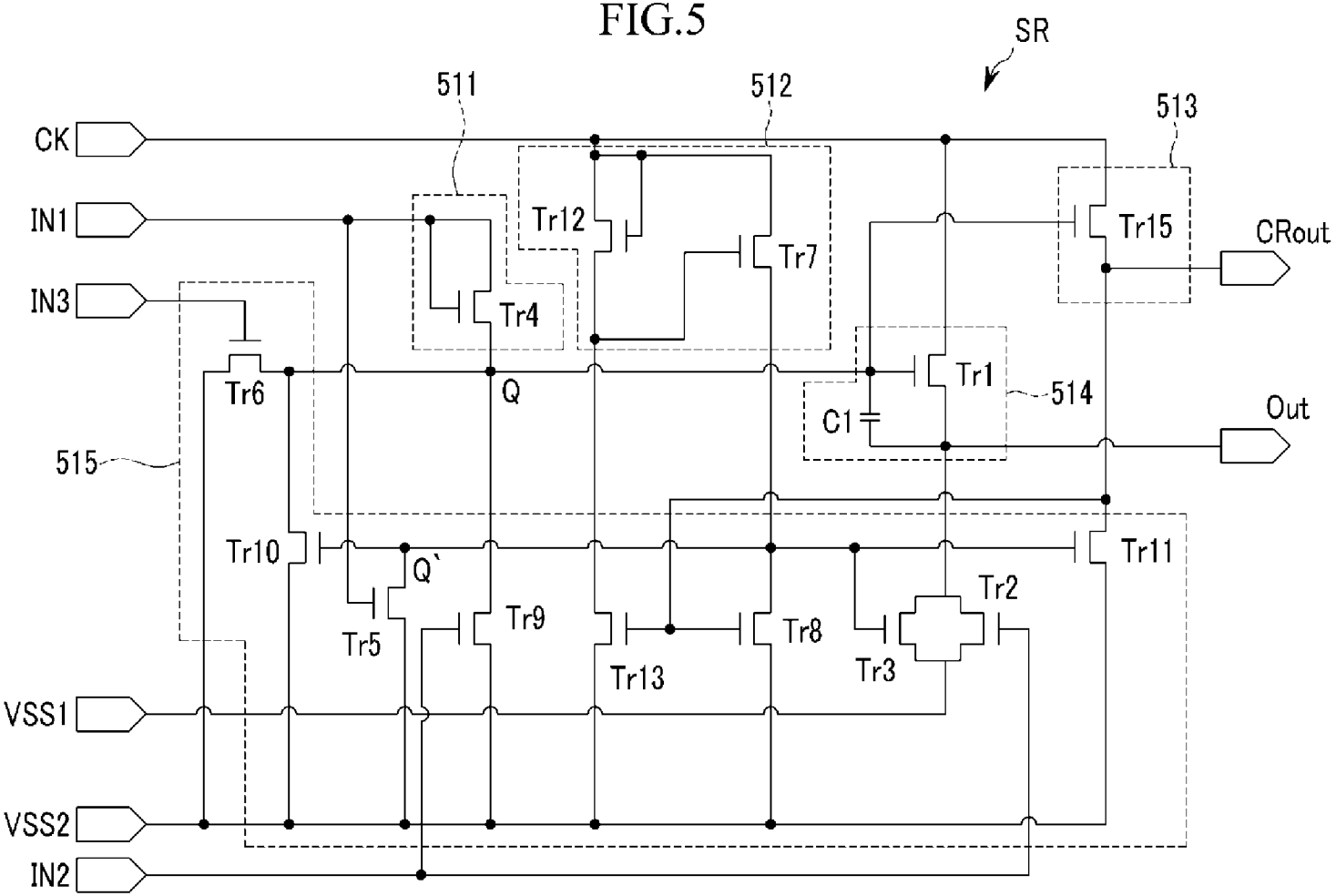
FIG. 5 is an enlarged circuit diagram to show a stage according to an exemplary is embodiment of the present invention.

FIG. 4 is an enlarged circuit diagram to show a stage according to an exemplary embodiment of the present invention, and FIG. 5 is an enlarged circuit diagram to show a stage according to an exemplary embodiment of the present invention.

As shown in FIGS. 4 and 5, a stage SR of the gate driver 500 may include an input unit 511, a pull-up driving unit 512, a transfer signal generating unit 513, an output unit 514, and a pull-down driving unit 515.

The input unit 511 may include a fourth transistor Tr4 and an input terminal, and a control terminal of the fourth transistor Tr4 may be common-connected (diode-connected) to the first input terminal IN1. An output terminal of the fourth transistor Tr4 may be connected to a Q contact point (hereinafter, also called a first node). When a high level voltage is applied to the first input terminal IN1, the input unit 511 transfers the high level voltage to the Q contact point.

The pull-up driving unit 512 may include a seventh transistor Tr7 and a twelfth transistor Tr12. A control terminal and an input terminal of the twelfth transistor Tr12 may be common-connected to each other to receive one of the clock signals CKV1, CKVB1, CKV2, and CKVB2 through the clock input terminal CK. An output terminal of the twelfth transistor Tr12 may be connected to a control terminal of the seventh transistor Tr7 and the pull-down driving unit 515. An input terminal of the seventh transistor Tr7 may also be connected to the clock input terminal CK, and an output terminal thereof may be connected to a Q' contact point (hereinafter, also called a second node) and the pull-down driving unit 515. A control terminal of the seventh transistor Tr7 may be connected to the output terminal of the twelfth transistor Tr12 and the pull-down driving unit 515. A parasite capacitor (not shown) may be formed between the input terminal and the control terminal and between the control terminal and the output terminal of the seventh transistor Tr7, respectively. When a high level signal is applied from the clock input terminal CK, the pull-up driving unit 512 transfers the high level signal to the control terminal of the seventh transistor Tr7 and the pull-down driving unit 515 through the twelfth transistor Tr12. Since the high level signal transferred to the seventh transistor Tr7 turns on the seventh transistor Tr7, the high level signal applied from the clock input terminal CK may be applied to the Q' contact point.

The transfer signal generating unit 513 may include a fifteenth transistor Tr15. An input terminal of the fifteenth transistor Tr15 may be connected to the clock input terminal CK and one of the clock signals CKV1, CKVB1, CKV2, and CKVB2 may be inputted to the input terminal of the fifteenth transistor Tr15. A control terminal of the fifteenth transistor Tr15 may be connected to the Q contact point corresponding to the output of the input unit 511 and an output terminal of the fifteenth transistor Tr15 may be connected to the transfer signal output terminal CRout to output the transfer signal. A parasite capacitor (not shown) may be formed between the control terminal and the output terminal of the fifteenth transistor Tr15. The output terminal of the fifteenth transistor Tr15 may be connected to the pull-down driving unit 515 to receive the second low voltage Vss2. Accordingly, the voltage of the low level transfer signal may be the second low voltage Vss2.

The output unit 514 may include a first transistor Tr1 and a first capacitor C1. The first transistor Tr1 is also called a driving transistor. A control terminal of the first transistor Tr1 may be connected to the Q contact point and an input terminal of the first transistor Tr1 may receive one of the clock signals CKV1, CKVB1, CKV2, and CKVB2 through the clock input is terminal CK. An output terminal of the first transistor Tr1 may be connected to the gate voltage output terminal OUT. The first capacitor C1 may be formed between the control terminal and the output terminal of the first transistor Tr1 and the output terminal may be connected with the gate voltage output terminal OUT. The output terminal of the first transistor Tr1 may also be connected to the pull-down driving unit 515 to receive the first low voltage Vss1. Accordingly, the voltage of the gate-off voltage may be the first low voltage Vss1. The output unit 514 may output the gate voltage according to the voltage on the Q contact point and one of the clock signals CKV1, CKVB1, CKV2, and CKVB2. The first transistor Tr1 may receive the first clock signal CKV1, and the control terminal of the first transistor Tr1 may be discharged by the second clock bar signal CKVB2. Therefore, a falling characteristic of the gate-on voltage applied to the gate line may be improved and an accurate data voltage may be applied to the pixel.

The pull-down driving unit 515 may remove charges on the stage SR, such that the gate-off voltage and the low level voltage of the transfer signal may be smoothly outputted. For example, the pull-down driving unit 515 may lower a potential of the Q contact point, a potential of the Q' contact point, the voltage outputted to the transfer signal, and the voltage outputted to the gate line. The pull-down driving unit 515 may include a second transistor Tr2, a third transistor Tr3, a fifth transistor Tr5, a sixth transistor Tr6, an eighth transistor Tr8 to an eleventh transistor Tr11, a thirteenth transistor Tr13, and a sixteenth transistor Tr16.

The transistors pulling-down the Q contact point in the pull-down driving unit 515 are the sixth transistor Tr6, the ninth transistor Tr9, the tenth transistor Tr10, and the sixteenth transistor Tr16.

A control terminal of the sixth transistor Tr6 may be connected to the third input terminal IN3, an output terminal of the sixth transistor Tr6 may be connected to the second is voltage input terminal Vin2, and an input terminal of the sixth transistor Tr6 may be connected to the Q contact point. Accordingly, the sixth transistor Tr6 may be turned-on according to the transfer signal applied through the third input terminal IN3, so as to lower the voltage of the Q contact point to the second low voltage Vss2.

The ninth transistor Tr9 and the sixteenth transistor Tr16 operate together to pull-down the Q contact point. A control terminal of the ninth transistor Tr9 may be connected to the second input terminal IN2, an input terminal of the ninth transistor Tr9 may be connected to the Q contact point, and an output terminal of the ninth transistor Tr9 may be connected to an input terminal and a control terminal of the sixteenth transistor Tr16. The control terminal and the input terminal of the sixteenth transistor Tr16 may be common-connected (diode-connected) with the output terminal of the ninth transistor Tr9. The sixteenth transistor Tr16 is a diode-connected transistor and slows down the discharge of the control terminal of the first transistor. An output terminal of the sixteenth transistor Tr16 may be connected to the second voltage input terminal Vin2. Accordingly, the ninth transistor Tr9 and the sixteenth transistor Tr16 may be turned-on according to the transfer signal applied through the second input terminal IN2 so as to lower the voltage of the Q contact point to the second low voltage Vss2.

As shown in FIG. 5, the diode connected sixteenth transistor Tr16 may be omitted. In other words, the output terminal of the ninth transistor Tr9 may be directly connected to the second voltage input terminal Vin2. In the case where the sixteenth transistor Tr16 includes an oxide semiconductor, as compared with amorphous silicon, a current characteristic of the sixteenth transistor Tr16 may be improved, such that the capacity of lowering the voltage of the Q contact point to the second low voltage Vss2 may be reduced and as a result, the role of the sixteenth transistor Tr16 may be diminished. Accordingly, the is sixteenth transistor Tr16 may be omitted in the stage SR, such that an area of the gate driver 500 may be reduced and the utilization of the display area 300 may be increased.

An input terminal of the tenth transistor Tr10 may be connected to the Q contact point, an output terminal of the tenth transistor Tr10 may be connected to the second voltage input terminal Vin2, and a control terminal of the tenth transistor Tr10 may be connected to the Q' contact point (also called an inverse terminal because the Q' contact point has an opposite phase to the voltage of the Q contact point). Accordingly, in a normal period where the Q' contact point has the high level voltage, the tenth transistor Tr10 continuously pulls down the voltage of the Q contact point to the second low voltage Vss2 and, only in a period where the Q' contact point has the low level voltage, the tenth transistor Tr10 does not pull down the voltage of the Q contact point. When the voltage of the Q contact point is not pulled down, the corresponding stage outputs the gate-on voltage and the transfer signal.

The transistors pulling-down the Q' contact point in the pull-down driving unit 515 are the fifth transistor Tr5, the eighth transistor Tr8, and the thirteenth transistor Tr13.

A control terminal of the fifth transistor Tr5 may be connected to the first input terminal IN1, an input terminal of the fifth transistor Tr5 may be connected to the Q' contact point, and an output terminal of the fifth transistor Tr5 may be connected to the second voltage input terminal Vin2. Accordingly, the fifth transistor Tr5 may lower the voltage of the Q' contact point to the second low voltage Vss2 according to the transfer signal inputted through the first input terminal IN1.

A control terminal of the eighth transistor Tr8 may be connected to the transfer signal output terminal CRout of a current terminal stage, an input terminal of the eighth transistor Tr8 may be connected to the Q' contact point, and an output terminal of the eighth transistor Tr8 is may be connected to the second voltage input terminal Vin2. Accordingly, the eighth transistor Tr8 may lower the voltage of the Q' contact point to the second low voltage Vss2 according to the transfer signal of the current terminal stage.

A control terminal of the thirteenth transistor Tr13 may be connected to the transfer signal output terminal CRout of the current terminal stage, an input terminal of the thirteenth transistor Tr13 may be connected to the output terminal of the twelfth transistor Tr12 of the pull-up driving unit 512, and an output terminal of the thirteenth transistor Tr13 may be connected to the second voltage input terminal Vin2. Accordingly, the thirteenth transistor Tr13 may lower a potential in the pull-up driving unit 512 to the second low voltage Vss2 according to the transfer signal of the current terminal stage and also lower the voltage of the Q' contact point connected to the pull-up driving unit 512 to the second low voltage Vss2. The thirteenth transistor Tr13 may discharge the internal charge of the pull-up driving unit 512 to the second low voltage Vss2, but since the pull-up driving unit 512 is connected to the Q' contact point, the thirteenth transistor Tr13 may not pull-up the voltage of the Q' contact point and may indirectly lower the voltage of the Q' contact point to the second low voltage Vss2.

The eleventh transistor Tr11 may lower the voltage outputted as the transfer signal in the pull-down driving unit 515. A control terminal of the eleventh transistor Tr11 may be connected to the Q' contact point, an input terminal of the eleventh transistor Tr11 may be connected to the transfer signal output terminal CRout, and an output terminal of the eleventh transistor Tr11 may be connected to the second voltage input terminal Vin2. Accordingly, when the voltage of the Q' contact point is a high level, the eleventh transistor Tr11 may lower the voltage of the transfer signal output terminal CRout to the second low voltage Vss2 and the transfer signal may be changed to a low level.

The second transistor Tr2 and the third transistor Tr3 may lower the voltage outputted to the gate line in the pull-down driving unit 515. The second transistor Tr2 may include a control terminal connected to the second input terminal IN2, an input terminal connected to the gate voltage output terminal OUT, and an output terminal connected to the first voltage input terminal Vin1. Accordingly, when the transfer signal inputted through the second input terminal IN2 is outputted, the second transistor Tr2 may change the outputted gate voltage to the first low voltage Vss1.

The third transistor Tr3 may include a control terminal connected to the Q' contact point, an input terminal connected to the gate voltage output terminal OUT, and an output terminal connected to the first voltage input terminal Vin1. Accordingly, when the voltage of the Q' contact point is a high-level, the third transistor Tr3 may change the outputted gate voltage to the first low voltage Vss1.

The pull-down driving unit 515 may lower the voltage of the gate voltage output terminal OUT to the first low voltage Vss1 and lower the voltages of the Q contact point, the Q' contact point, and the transfer signal output terminal CRout to the second low voltage Vss2 lower than the first low voltage Vss1. Accordingly, the gate-on voltage and the high-level voltage of the transfer signal may have substantially the same voltage as each other and the gate-off voltage and the low-level voltage of the transfer signal may have different values. The gate-off voltage may be the first low voltage Vss1 and the low-level voltage of the transfer signal may be the second low voltage Vss2.

For example, the gate-on voltage may be 25 V, the gate-off voltage and the first low voltage Vss1 may be −5 V, the high-level voltage of the transfer signal may be 25 V, and the low-level voltage of the transfer signal and the second low voltage Vss2 may be −10 V.

The transfer signal generating unit 513 and the output unit 514 may operate by the voltage of the Q contact point, such that the stage SR outputs the high-level voltage of the transfer signal and the gate-on voltage. By the transfer signals inputted through the first input terminal IN1, the second input terminal IN2, and the third input terminal IN3, the high-level voltage of the transfer signal may be lowered to the second low voltage Vss2 and the gate-on voltage may be lowered to the first low voltage Vss1 to be changed to the gate-off voltage. The stage SR may lower the voltage of the Q contact point to the second low voltage Vss2 by the transfer signal, such that power consumption of the stage SR may be reduced. In addition, since the second low voltage Vss2 may be lower than the first low voltage Vss1 as the gate-off voltage, although the voltage of the transfer signal applied in another stage may be changed due to a ripple, a noise, and the like, the value of the second low voltage Vss2 may be sufficiently lowered and as a result, a leakage current of the transistors included in the stage SR may be reduced, such that the power consumption of the stage SR may be reduced.

Figure 6A:
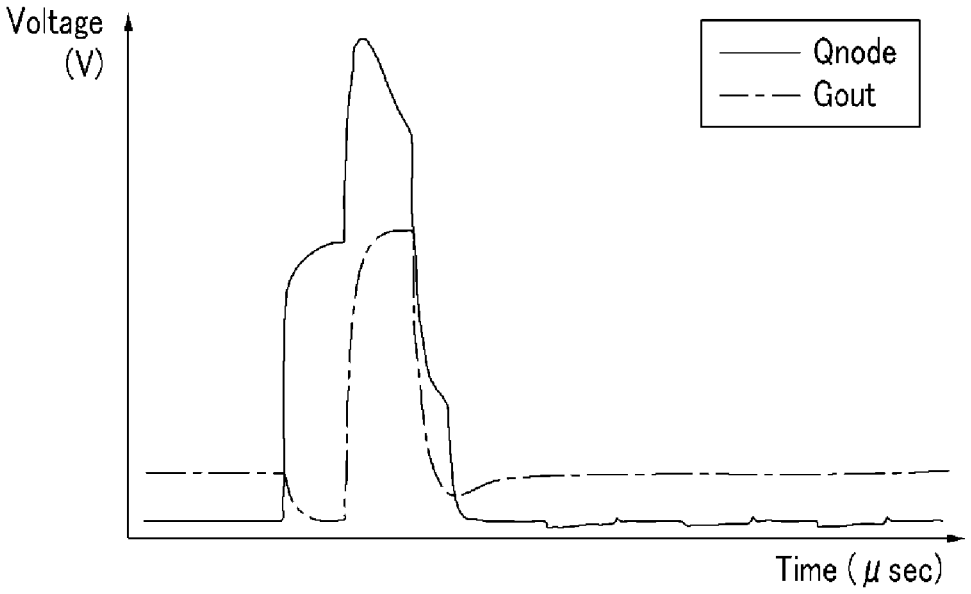
FIG. 6A is a signal waveform diagram of a Q node and gate voltage according to the exemplary embodiment of the present invention and FIG. 6B is a signal waveform diagram of a Q node and gate voltage according to a comparative example.
Figure 6B:
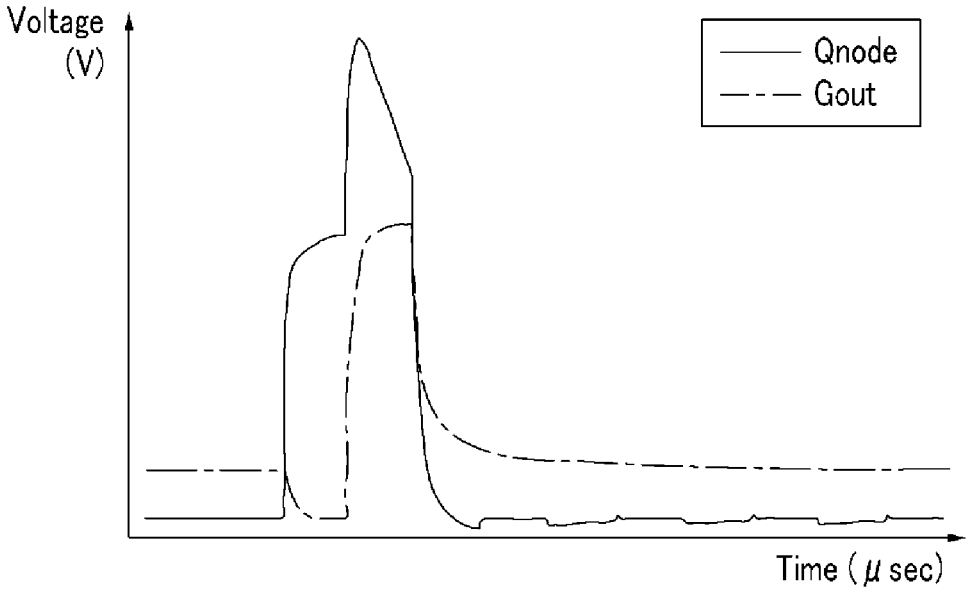

FIG. 6A is a signal waveform diagram of a Q node and a gate voltage according to an exemplary embodiment of the present invention, and FIG. 6B is a signal waveform diagram of a Q node and a gate voltage according to a comparative example.

The gate driver according to an exemplary embodiment of the present invention may include, as shown in FIG. 2, a stage receiving the first clock signal CKV1 that receives the transfer signal from a stage driven by the second clock bar signal CKVB2, and a stage SR including a sixteenth transistor Tr16 as shown in FIG. 4. The gate driver shows a signal waveform diagram as shown in FIG. 6A. A gate driver of a comparative example includes a stage receiving the first clock signal CKV1 that receives the transfer signal from a stage driven by the first clock bar signal CKVB1, and the stage SR including the sixteenth transistor as shown is in FIG. 4. A gate driver of the comparative example shows a signal waveform diagram as shown in FIG. 6B. Both the gate driver according to the exemplary embodiment of the present invention and the gate driver of the comparative example may include amorphous silicon. The on-pulse of the second clock bar signal CKVB2 may be applied later than the on-pulse of the first clock bar signal CKVB1, such that a discharging speed of the Q contact point may be decreased and a turn-on time of the first transistor Tr1 may be increased. Accordingly, the gate voltage output terminal OUT may use the second transistor Tr2 for the discharge of the gate voltage and the low-level voltage of the first clock signal CKV1 for the discharge of the gate voltage through the first transistor Tr1, thereby reducing a falling time of the gate-on voltage. For example, since a falling time of the gate-on voltage in the gate driver of the comparative example is about 24 μsec and a falling time of the gate-on voltage in the gate driver according to an exemplary embodiment of the present invention is about 4 μsec, the falling time of the gate-on voltage may be decreased by about ⅙ and a falling characteristic of the gate-on voltage may be improved by about six times.

Figure 7:
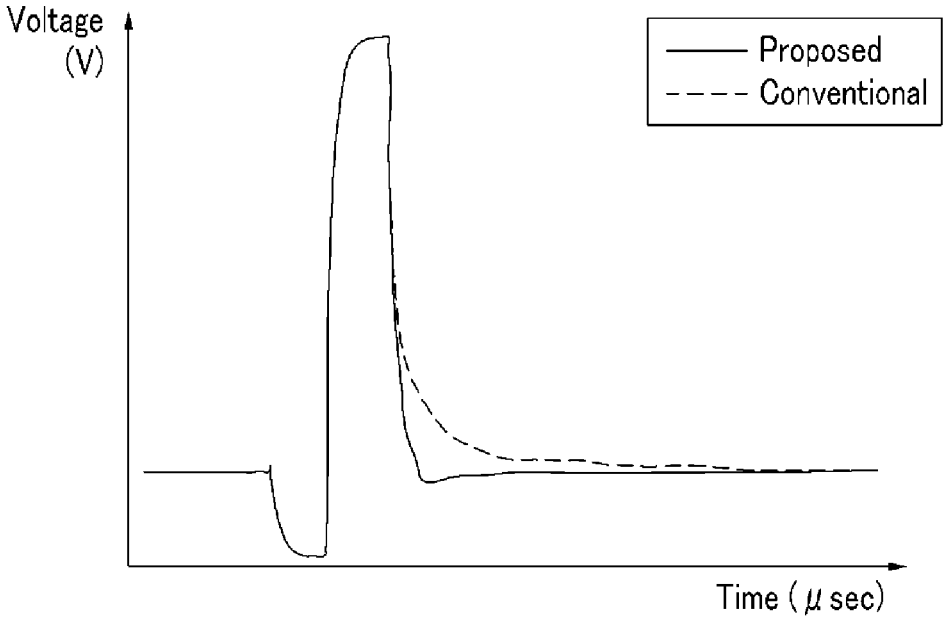
FIG. 7 is a signal waveform diagram of gate voltage according to an exemplary embodiment of the present invention and a comparative example.

FIG. 7 is a signal waveform diagram of gate voltage according to an exemplary embodiment of the present invention and the comparative example.

According to a structure of the proposed gate driver, the stage that receives the first clock signal CKV1 may receive the transfer signal from the stage driven by the second clock bar signal CKVB2 as shown in FIG. 2, and the proposed gate may include a stage SR without the sixteenth transistor Tr16 as shown in FIG. 5. In a gate driver of the comparative example, the stage that receives the first clock signal CKV1 receives the transfer signal from the stage driven by the first clock bar signal CKVB1, and includes the stage SR including the sixteenth transistor as shown in FIG. 4. Both the proposed gate driver and the gate driver of the comparative is example include amorphous silicon. The on-pulse of the second clock bar signal CKVB2 may be applied later than the on-pulse of the first clock bar signal CKVB1, such that the falling time of the gate-on voltage may be lowered. The sixteenth transistor Tr16 may be omitted in the stage SR, such that an area of the gate driver 500 may be decreased and the utilization of the display area 300 may be increased. For example, the sixteenth transistor Tr16 may be omitted, such that the area of the gate driver 500 may be decreased by about 9% based on a panel of 18.5 inches.

Figure 8:
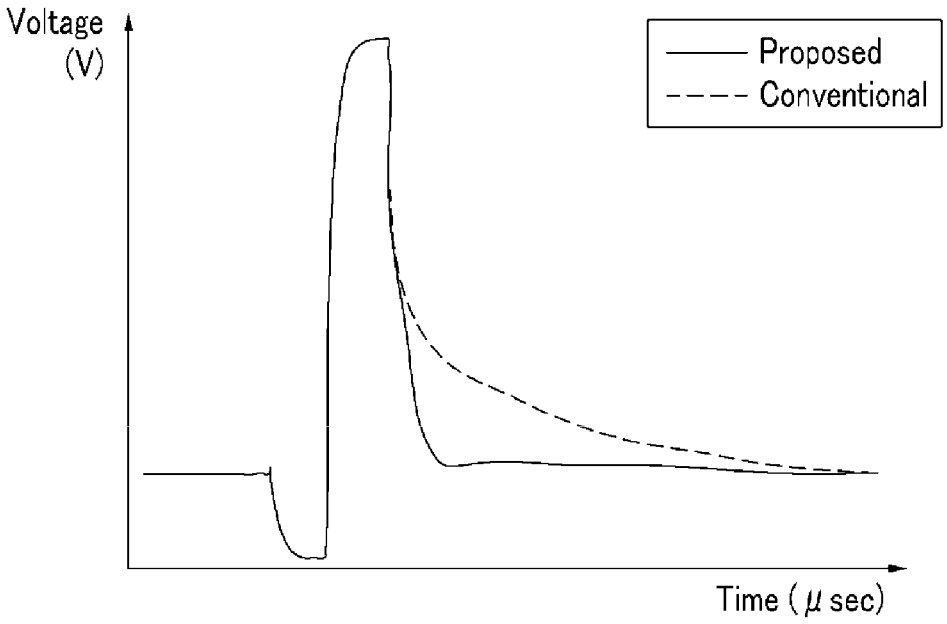
FIG. 8 is a signal waveform diagram of gate voltage according to an exemplary embodiment of the present invention and a comparative example.

FIG. 8 is a signal waveform diagram of gate voltage according to the exemplary embodiment of the present invention and the comparative example.

According to a structure of the proposed gate driver, the stage that receives the first clock signal CKV1 may receive the transfer signal from the stage driven by the second clock bar signal CKVB2 as shown in FIG. 2, and may include the stage SR without the sixteenth transistor Tr16 as shown in FIG. 5. A gate driver of a comparative example receives the transfer signal from the stage driven by the first clock bar signal CKVB1 at the stage thereof receiving the first clock signal CKV1 and may include the stage SR including the sixteenth transistor as shown in FIG. 4. Both the proposed gate driver and the gate driver of the comparative example may include GIZO which is an oxide semiconductor. The on-pulse of the second clock bar signal CKVB2 may be applied later than the on-pulse of the first clock bar signal CKVB1, such that a falling time of the gate-on voltage may be lowered. In addition, a falling characteristic of the gate-on voltage of the proposed gate driver including the oxide semiconductor in FIG. 8 may be more improved than a falling characteristic of the gate-on voltage of the gate driver of the comparative example including amorphous silicon in FIG. 7. The sixteenth transistor Tr16 may be omitted in the stage SR, such that an area of the gate driver 500 may be decreased and the utilization of the display area 300 may be increased.

According to exemplary embodiments of the present invention, a falling characteristic of gate-on voltage of the gate driver may be improved, accurate data voltages may be applied to a pixel, an area of the gate driver may decrease, and the utilization of the display area may increase.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display panel, comprising:

a display area; and a gate driver configured to receive a plurality of clock signals comprising a first clock signal, a first clock bar signal, a second clock signal and a second clock bar signal, the gate driver comprising a first stage and a second stage, each of the first stage and the second stage configured to receive only one clock signal of the plurality of clock signals and respectively apply a first gate voltage and a second gate voltage to the display area, the gate driver integrated on a substrate, wherein the first clock signal and the first clock bar signal have opposite phases to each other, the second clock signal and the second clock bar signal have opposite phases to each other, the second clock bar signal has phases later than the first clock bar signal, the first stage discharges the first gate voltage based on the first clock signal and a first transfer signal, and the second stage outputs the first transfer signal based on the second clock bar signal, and wherein the first stage is configured to receive a first low voltage and a second low voltage lower than the first low voltage and receive a second transfer signal and a third transfer signal from two different stages other than the first stage and the second stage, respectively, and the first gate voltage is the first low voltage.

2. The display panel of claim 1, wherein:

the first stage comprises a pull-down driving unit and the pull-down driving unit does not comprise a diode-connected transistor.

3. The display panel of claim 2, wherein:

the first stage and the second stage each comprise a transistor comprising an oxide semiconductor.

4. The display panel of claim 2, wherein:

the first stage and the second stage each comprise a transistor comprising amorphous silicon.

5. The display panel of claim 1, wherein:

the second low voltage is a voltage of the first transfer signal when the first transfer signal is a low level.

6. The display panel of claim 5, wherein:

a period of the first clock signal is T and the second clock bar signal is out of phase with the first clock bar signal by T/4.

7. The display panel of claim 1, wherein:

the first stage comprises a pull-down driving unit and the pull-down driving unit comprises a diode-connected transistor.

8. The display panel of claim 7, wherein:

the first stage and the second stage each comprise a transistor comprising an oxide semiconductor.

9. The display panel of claim 7, wherein:

the first stage and the second stage each comprise a transistor comprising amorphous silicon.

10. The display panel of claim 1, wherein:

the first stage and the second stage each comprise a transistor comprising an oxide semiconductor.

11. The display panel of claim 1, wherein:

the first stage and the second stage each comprise a transistor comprising Amorphous silicon.

12. The display panel of claim 1, wherein:

the first stage receives a first low voltage and a second low voltage lower than the first low voltage and receives a second transfer signal and a third transfer signal from two different stages other than the first stage and the second stage, respectively, and the first gate voltage is the first low voltage.

13. The display panel of claim 12, wherein:

the second low voltage is a voltage of the first transfer signal when the first transfer signal is a low level.

14. The display panel of claim 1, wherein:

the first stage comprises an input unit, a pull-up driving unit, a pull-down driving unit, an output unit, and a transfer signal generating unit.

15. The display panel of claim 14, wherein:

the input unit, the pull-down driving unit, the output unit, and the transfer signal generating unit are connected to a first node.

16. The display panel of claim 15, wherein:

the pull-up driving unit and the pull-down driving unit are connected to a second node.

17. A display panel, comprising:

a display area; and a gate driver configured to receive a plurality of clock signals comprising a first clock signal, a first clock bar signal, a second clock signal and a second clock bar signal, the gate driver comprising a plurality of stages, each of the plurality of stages configured to receive only one clock signal of the plurality of clock signals and respectively apply a gate voltage to the display area, wherein the first clock signal and the first clock bar signal have opposite phases to each other, the second clock signal and the second clock bar signal have opposite phases to each other, the second clock bar signal has phases later than the first clock bar signal, and the plurality of stages comprise:

a first stage configured to receive the first clock signal and output a first transfer signal;

a second stage configured to receive the second clock signal and outputting a second transfer signal;

a third stage configured to receive the first clock bar signal and output a third transfer signal;

a fourth stage configured to receive the second clock bar signal and output a fourth transfer signal;

a fifth stage configured to receive the first clock signal and output a fifth transfer signal;

a sixth stage configured to receive the second clock signal and output a sixth transfer signal; and a seventh stage configured to receive the first clock bar signal and output a seventh transfer signal, wherein a first input terminal of the first stage and a first input terminal of the second stage receive a scan start signal, a first input terminal of the third stage receives the first transfer signal, and a first input terminal of the fourth stage receives the second transfer signal, and wherein a second input terminal of the first stage receives the fourth transfer signal, a second input terminal of the second stage receives the fifth transfer signal, a second input terminal of the third stage receives the sixth transfer signal, and a second input terminal of the fourth stage receives the seventh transfer signal.

18. The display panel of claim 17, wherein:

the plurality of stages further comprises an eighth stage configured to receive the second clock bar signal and output an eighth transfer signal, and a third input terminal of the first stage receives the fifth transfer signal, a third input terminal of the second stage receives the sixth transfer signal, a third input terminal of the third stage receives the seventh transfer signal, and a third input terminal of the fourth stage receives the eighth transfer signal.

19. The display panel of claim 18, wherein:

the first stage to the fourth stage each comprises a first voltage input terminal configured to receive the first low voltage and a second voltage input terminal configured to receive the second low voltage lower than the first low voltage.

20. The display panel of claim 19, wherein:

the first stage to the fourth stage each applies the first gate voltage to the fourth gate voltage to the display area.

21. The display panel of claim 20, wherein:

the first stage comprises a pull-down driving unit and the pull-down driving unit does not comprise a diode-connected transistor.

22. The display panel of claim 21, wherein:

the first stage and the second stage each comprise a transistor comprising an oxide semiconductor.

23. The display panel of claim 21, wherein:

the first stage and the second stage each comprise a transistor comprising amorphous silicon.

24. The display panel of claim 20, wherein:

the first stage comprises a pull-down driving unit and the pull-down driving unit comprises a diode-connected transistor.

25. The display panel of claim 17, wherein:

the plurality of stages comprises a dummy stage.

26. The display panel of claim 25, wherein:

the dummy stage is connected to a gate line of a dummy pixel which does not display an image.

27. A display panel, comprising:

a display area; and a gate driver configured to receive a plurality of clock signals comprising a first clock signal, a first clock bar signal, a second clock signal and a second clock bar signal, the gate driver comprising a stage configured to receive only one clock signal of the plurality of clock signals, the stage comprising a driving transistor configured to output a gate voltage to the display area, the gate driver integrated on a substrate, wherein the first clock signal and the first clock bar signal have opposite phases to each other, the second clock signal and the second clock bar signal have opposite phases to each other, the second clock bar signal has phases later than the first clock signal, the driving transistor receives the first clock signal, and a control terminal of the driving transistor is discharged by the second clock bar signal, and wherein the stage is configured to receive a first low voltage and a second low voltage lower than the first low voltage and receive a second transfer signal and a third transfer signal from two different stages other than the stage, respectively, and the first gate voltage is the first low voltage.

28. The display panel of claim 27, wherein:

the gate driver does not comprise a diode-connected transistor slowing down the discharge of a control terminal of the driving transistor.

29. The display panel of claim 28, wherein:

the driving transistor comprises an oxide semiconductor.

30. The display panel of claim 28, wherein:

the driving transistor comprises amorphous silicon.

31. The display panel of claim 27, wherein:

the gate driver comprises a diode-connected transistor slowing down the discharge of a control terminal of the driving transistor.

32. The display panel of claim 31, wherein:

the driving transistor and the diode-connected transistor comprise an oxide semiconductor.

33. The display panel of claim 31, wherein:

the driving transistor and the diode-connected transistor comprise amorphous silicon.

34. A method for driving a display panel, comprising:

receiving a plurality of clock signals comprising a first clock signal, a first clock bar signal, a second clock signal and a second clock bar signal;

applying, by a first stage, a first gate voltage to a first gate line;

applying, by a second stage, a second gate voltage to a second gate line;

outputting a first transfer signal from the second stage based on the second clock bar signal;

discharging the first gate voltage on the first gate line based on the first clock signal and the first transfer signal;

receiving by the first stage a first low voltage and a second low voltage lower than the first low voltage, and the first gate voltage is the first low voltage; and receiving a second transfer signal and a third transfer signal from two different stages other than the first stage and the second stage, respectively, wherein the first clock signal and the first clock bar signal have opposite phases to each other, the second clock signal and the second clock bar signal have opposite phases to each other, and the second clock bar signal has phases later than the first clock bar signal, and wherein each of the first stage and the second stage is configured to receive only one clock signal of the plurality of clock signals.

35. The display panel of claim 34, wherein:

the second low voltage is a voltage of the first transfer signal when the first transfer signal is a low level.

36. The display panel of claim 35, wherein:

a period of the first clock signal is T and the second clock bar signal is out of phase with the first clock bar signal by T/4.

* * * * *